United States Patent [19]

Deering

[11] Patent Number: 4,564,437

[45] Date of Patent: Jan. 14, 1986

[54] PROCESS FOR RETORTING OIL SHALE WITH FLUIDIZED RETORTING OF SHALE FINES

[75] Inventor: Roland F. Deering, Brea, Calif.

[73] Assignee: Union Oil Company of California, Los Angeles, Calif.

[21] Appl. No.: 626,673

[22] Filed: Jul. 2, 1984

Related U.S. Application Data

[63] Continuation-in-part of Ser. No. 510,402, Jul. 5, 1983, Pat. No. 4,515,679, which is a continuation-in-part of Ser. No. 451,602, Dec. 20, 1982, Pat. No. 4,448,668.

[51] Int. Cl.[4] ..... C10G 1/02

[52] U.S. Cl. ..... 208/11 R

[58] Field of Search ..... 208/11 R

[56] References Cited

U.S. PATENT DOCUMENTS

| | | | |
|---|---|---|---|
| 2,783,898 | 3/1957 | Ardern et al. | 208/11 R |
| 2,966,446 | 12/1960 | Deering | 208/11 R |
| 3,004,898 | 10/1961 | Deering | 208/11 R |
| 3,361,644 | 1/1968 | Deering | 208/11 R |
| 3,501,394 | 3/1970 | Lyons | 208/11 R |
| 3,976,558 | 8/1976 | Hall | 208/11 R |
| 4,003,797 | 1/1977 | Cheadle et al. | 208/11 R |
| 4,004,982 | 1/1977 | Jennings et al. | 208/11 R |
| 4,010,092 | 3/1977 | Deering | 208/11 R |
| 4,069,132 | 1/1978 | Deering | 208/11 R |
| 4,083,770 | 4/1978 | Deering | 208/11 R |
| 4,162,960 | 7/1979 | Dhoudt | 208/11 R |
| 4,263,124 | 4/1981 | Wickstrom et al. | 208/11 R |
| 4,273,617 | 6/1981 | Goedde et al. | 208/11 R |
| 4,288,294 | 9/1981 | Velling | 208/11 R |
| 4,312,740 | 1/1982 | Chiaramonte | 208/11 R |
| 4,314,899 | 2/1982 | Styring, Jr. | 208/11 R |
| 4,332,669 | 6/1982 | Spars et al. | 208/11 R |
| 4,336,126 | 6/1982 | Bertelsen | 208/11 R |
| 4,336,127 | 6/1982 | Bertelsen | 208/11 R |
| 4,340,463 | 7/1982 | Harak | 208/11 R |
| 4,366,046 | 12/1982 | Bertelsen | 208/11 R |
| 4,402,823 | 9/1983 | Bertelsen | 208/11 R |
| 4,435,271 | 3/1984 | Deering et al. | 208/11 R |
| 4,446,001 | 5/1984 | Deering et al. | 208/11 R |
| 4,448,668 | 5/1984 | Deering | 208/11 R |
| 4,515,679 | 5/1985 | Deering | 208/11 R |

OTHER PUBLICATIONS

Miller et al., "Premium Sylicrude from Oil Shale Using Union Oil Technology", 1982 Natl Petroleum Refiner's Mtg, Mar. 21-23, 1982 in San Antonio, Texas.

Randle et al., "Synthetic Crude Oil and Transportation Fuels from Oil Shale", Mtg of API Refining Dept., May 11-14, 1981 in Chicago, Ill.

Mathews, "Improvements in Oil Shale Retorts", *Synthetic Fuels from Oil Shale II*, Inst. of Gas Technol, Mar., 1982.

*Primary Examiner*—John Doll

*Assistant Examiner*—Lance Johnson

*Attorney, Agent, or Firm*—June M. Bostich; Gregory F. Wirzbicki; Dean Sandford

[57] ABSTRACT

Hot, coarse, particles removed from a retort, preferably coarse particles of oil shale removed from a retort operating at superatmospheric pressure, are crushed to a size suitable for fluidization and then fed to a fluidization zone maintained under non-oxidizing conditions at substantially the pressure of the retort to forestall escape of retort gases. Raw fines are introduced into the fluidization zone and retorted without agglomeration using heat transferred from the hot retorted particles. Also introduced into the fluidization zone is a heated fluidizing gas stream comprised of recycle retort gas, which is employed to educe hydrocarbonaceous vapors from the fines and, optionally transfer heat. Educed vapors from the fluidization zone are recycled to the retort to be partially condensed and recovered as liquid and gaseous product streams along with other vapors educed in the retort.

43 Claims, 1 Drawing Figure

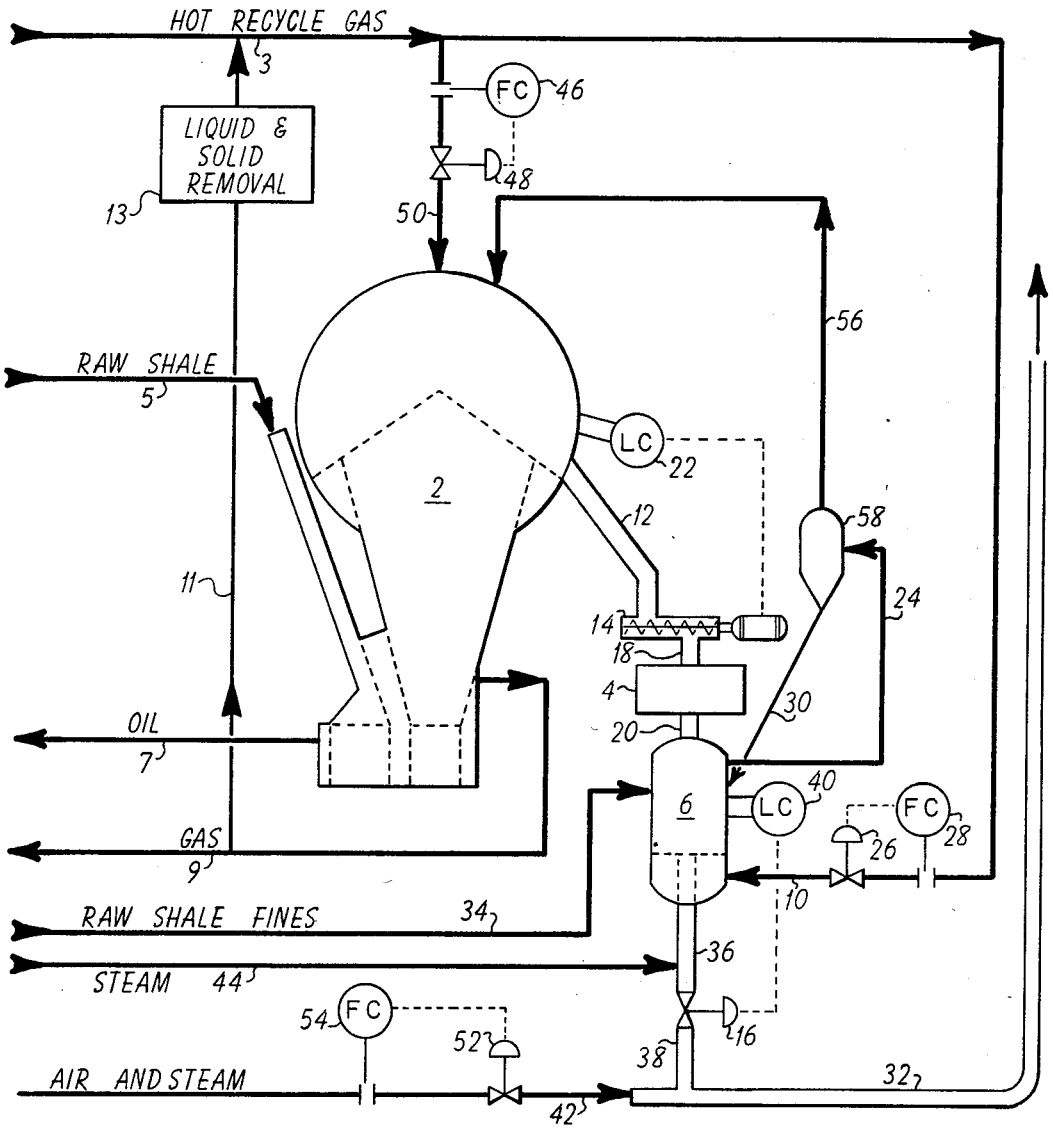
HOT RECYCLE GAS
3
LIQUID & SOLID REMOVAL
13
FC
46
48
50
56
RAW SHALE
5
LC
22
2
12
58
11
24
14
18
4
30
20
OIL
7
6
LC
40
FC
28
26
GAS
9
10
RAW SHALE FINES
34
36
STEAM
44
54
FC
52
16
38
AIR AND STEAM
42
32

PROCESS FOR RETORTING OIL SHALE WITH FLUIDIZED RETORTING OF SHALE FINES

CROSS-REFERENCE TO RELATED APPLICATIONS

This application is a continuation in part of U.S. patent application Ser. No. 510,402, filed July 5, 1983, entitled "PROCESS FOR RETORTING OIL SHALE WITH FLUIDIZED RETORTING OF SHALE FINES," now U.S. Pat. No. 4,515,679 which is a continuation-in-part of U.S. patent application Ser. No. 451,602, filed Dec. 20, 1982, entitled "A PROCESS FOR RETORTING OIL SHALE WITH MAXIMUM HEAT RECOVERY," now U.S. Pat. No. 4,448,668.

BACKGROUND OF THE INVENTION

This invention relates to a retorting process for recovering product hydrocarbons from oil shale and other hydrocarbon-bearing solids. The invention most particularly relates to those oil shale retorting processes wherein heat energy in retorted shale particles is used to recover product hydrocarbons from raw shale fines.

Many methods for recovering oil from oil shale have been proposed, nearly all of which utilize some method of pyrolytic eduction commonly known as retorting. To be competitive with the production of oils from petroleum stocks, one difficulty to be overcome is the recovery of essentially all heat value from carbonaceous material in the shale without incurring prohibitive expense or environmental damage. Since shale usually contains only about 20 to 80 gallons of oil per ton, only a limited proportion of which can be recovered as product oil or gas, economical retorting must utilize remaining heat energy contained in the shale to provide heat for pyrolytic eduction. However, sulfur emissions in flue gases released from the retorting process must be restricted to the low levels required by law while this goal is being attained.

It is known to retort oil shale by a technique of contacting up-flowing oil-bearing solids with downflowing gases in a vertical retort, and one such technique is disclosed in U.S. Pat. No. 3,361,644. To educe product vapors, the upward-moving bed of shale particles exchanges heat with a downflowing, hydrocarbonaceous and oxygen-free eduction gas of high specific heat introduced into the top of the retort at about 950° to 1200° F. In the upper portion of the retort, the hot eduction gas educes hydrogen and hydrocarbonaceous vapors from the shale and, in the lower portion, preheats the ascending bed of particles to retorting temperatures. As preheating continues, the eduction gas steadily drops in temperature, condensing high boiling hydrocarbonaceous vapors into a raw shale oil product while leaving a product gas of relatively high BTU content. The shale oil and product gas are then separated, and a portion of the product gas, after being heated, is recycled to the top of the retort as the eduction gas.

To minimize the volume of the recycle gas required, upflow retorting is usually conducted under superatmospheric pressure with the pressure in the upper regions of the retort often being between 10 and 50 p.s.i.g. However, means must be provided for introducing and recovering granular shale from the superatmospheric retorting zone without allowing valuable product and recycle gases to depressure. Conventional methods for achieving these objectives use elaborate lock vessels, valves, star feeders, or slide valves, which tend to wear rapidly and produce excessive fines through abrading the shale. Alternatively, liquid sealing devices, as in U.S. Pat. No. 4,004,982, have been employed, which operate by moving shale particles through a standing head of oil or water, thereby creating a positive back pressure to forestall escape of retort gases. Liquid seals effectively contain retort gases but leave the shale wet. When incorporated into a process for combusting retorted shale in a vessel separate from the retort, use of liquid seals would require the expense of drying the shale prior to combustion.

To increase product yield beyond what can be educed in the retort alone, processes have been developed to generate product gases by reaction of hot, retorted shale with an oxidizing gas stream, for example, as taught in U.S. Pat. No. 4,010,092. However, such gasification reactions conducted in an oxidizing environment burn the coke on retorted shale at temperatures high enough to release significant amounts of carbon dioxide from decomposing carbonates in the shale, thereby necessitating expensive removal of carbon dioxide from combustible product gases.

Another source of product yield is unretorted shale fines. Shale mined for the purpose of retorting in above-ground retorts is usually crushed mechanically to a size suitable for retorting, for example, about three inches in diameter, or smaller. Due to the friable nature of shale, fines ranging in size up to about one-half inch in diameter are generated in the mining and crushing of larger retort-sized particles in amounts up to about 10 weight percent of the total shale mined. In processes developed for use with above-ground retorts, fines mixed into the feed of larger, retort-sized particles tend to fill the void spaces between the larger particles and agglomerate during retorting. As a result, circulation of hot eduction gases is channeled into the few available unfilled passageways through the voids, which consequently overheat, while circulation of heat to the rest of the retort is blocked off, leaving larger underheated areas. When fines are segregated from the feed to the retort to avoid this problem, an appreciable portion of the energy available from the shale is wasted.

Retorted shale contains heat value in the form of coke, and many retorting processes pass retorted shale particulates through a combustion zone to combust the coke and thus recover heat energy. However, because retorted shale generally contains sulfur components, less than complete combustion of the coke generates hydrogen sulfide, which must be removed from flue gases by means of costly sulfur recovery processes. On the other hand, complete combustion may result in flue gases containing unacceptable amounts of sulfur dioxide. To solve the problem of sulfur dioxide production during complete combustion, U.S. Pat. No. 4,069,132 discloses a combustion process wherein the sulfur dioxide generated during the combustion of coke on the retorted shale is converted to stable inorganic salts by reaction with alkaline ingredients of the shale. This process utilizes a combustor through which hot, retorted shale gravitates cocurrently with air for combustion diluted by sufficient flue gas to control peak combustion temperature below 1670° F. Under such conditions, the discharge of sulfur dioxide from the combustor is disclosed to be greatly minimized.

Because flue gases from combustion zones associated with shale retorts are usually at high temperature, many retorting processes recover heat therefrom. For example, as taught in U.S. Pat. No. 4,069,132, the hot flue gases may be utilized to exchange heat indirectly with boiler feedwater to generate process steam.

While the aforementioned features have met with some success, the need exists for further developments in shale retorting processes. For example, the need exists for a process by which raw shale fines can be retorted to educe and recover hydrocarbon products using heat contained in shale particles removed from an oil shale retort and without necessitating separate facilities for recovering and condensing the hydrocarbon products so educed from the fines.

Accordingly, a principal object of this invention is to provide a process for recovering up to 100 percent of the Fischer assay of hydrocarbons from raw shale fines utilizing the heat contained in retorted shale particles removed from a shale retort to educe product vapors from the fines while additional product vapors are educed from the retorted shale particles.

Another object of this invention is to provide a process for removing retorted shale particles from a retort while sealing the retort gases therein, crushing the particles under elevated pressure to a size suitable for fluidization, and subsequently holding the crushed particles as a fluidized bed to aid in sealing the retort while using heat energy contained in the crushed particles and in recycle retort gases to effect flash pyrolysis of unretorted fines so that up to 100 percent of the Fischer assay of product hydrocarbons contained therein is recovered.

Yet another object of the invention is to retort raw shale fines using a particulate heat source held as a fluidized bed to facilitate heat exchange and prevent agglomeration of the fines.

It is another object of the invention to integrate the foregoing process and apparatus into an overall process for retorting oil shale, recovering the retorted shale without loss of retort gases, using the retorted shale to educe product hydrocarbons from unretorted shale fines under fluidized conditions while achieving secondary retorting of the retorting shale and, optionally, combusting residual coke on the retorted shale under fluidized conditions for the purpose of recovering heat derived from the combustion of said coke.

These and other objects of the invention will become more readily understood in light of the following description and claims.

SUMMARY OF THE INVENTION

A particulate heat source removed from a retort without loss of retort gases, preferably coarse, retorted shale particles removed from an oil shale retort operating at superatmospheric pressure, is crushed to a size suitable for fluidization and held in a fluidized bed at substantially retort pressure by the action of a hot, nonoxidizing fluidizing gas stream. Raw fines containing thermally decomposable carbonaceous material, preferably raw shale fines, are introduced into the fluidized bed and retorted, usually without substantial agglomeration, by heat transfer with the fluidizing gas stream and/or particulate heat source so as to educe hydrocarbonaceous vapors while the particulate heat source undergoes secondary retorting of remaining hydrocarbon materials contained therein. The fluidizing gas stream comprises a portion of recycle retort gases, which gases are recovered along with educed product vapors from the fines and passed to the retort for partial condensation and recovery of product liquids and gases in a single hydrocarbon recovery facility. Crushed particles are recovered from the fluidized bed while flow of gases accompanying said particles is restricted.

BRIEF DESCRIPTION OF THE DRAWING

The drawing depicts a flowsheet of the preferred embodiment of the invention wherein hot, crushed shale particles recovered from an oil shale retort are used in a fluidized retorting zone to retort raw shale fines in a fluidized retorting zone which is maintained as a fluidized bed by a stream of hot, recycle retort gases.

It will be understood, however, that for the sake of simplicity, and in keeping with the usual purpose of a flowsheet, a number of conventional items such as pumps, compressors, and other equipment which themselves form no part of the invention nor aid in its description have been omitted.

DETAILED DESCRIPTION OF THE INVENTION

The preferred embodiment of the invention shown in the drawing comprises a process for educing hydrocarbon products from raw shale fines in fluidized surge vessel 6 using heat provided by hot, retorted shale particles removed from retort 2 and a hot fluidizing gas stream comprising recycle retort gases from conduit 10. In this invention, shale particles removed from retort 2 without substantial loss of pressure and without substantial loss of retort gases are crushed to a size suitable for fluidization at substantially retort pressure before entry into surge vessel 6. Within surge vessel 6, a fluidized bed is maintained so that high contact and heat transfer efficiencies are attained between the heated particles introduced through standpipe 20 and the raw fines introduced through conduit 34. Conditions maintained in the fluidized bed are such that hydrocarbonaceous vapors representing between 80 and 100 percent of the Fischer assay of the raw fines are educed therefrom and recovered via conduit 24, while the crushed, retorted shale particles also undergo secondary retorting of residual hydrocarbonaceous materials contained therein. After treatment in separator 58 to remove fines, the educed vapors are recycled via conduit 56 into retort 2 along with the fluidizing gas stream to be used as a portion of the retorting gases. Fines removed from the educed vapors in conduit 24 by separator 58 are returned via conduit 30 to surge vessel 6.

More particularly, raw, coarse oil shale particulates (typically having a mean diameter no greater than 6 inches, preferably no greater than 3 inches), are fed at 5 into conventional upflow shale retort 2, such as that described in U.S. Pat. No. 3,361,644, which is incorporated herein by reference. Retorting is accomplished in retort 2 in a manner similar to that described in the aforementioned patent by passing raw shale upwardly through the retort. Pressure in the retort is usually between about 5 and 30 p.s.i.g., preferably about 15 p.s.i.g. Temperature of the upflowing shale is gradually increased to retorting levels, usually in excess of about 600° F., and preferably between 900° and 1200° F., by hot, countercurrently flowing eduction gases introduced via conduit 3 comprising a preheated recycle portion of retort product gas from conduit 9 passed to conduit 3 N/A conduit 11 (usually after removal of entrained liquid and solids in separation facilities 13). The recycled product gas stream is divided into two streams. The first portion which enters retort 2 directly via conduit 50, supplies the major proportion of the heat for retorting. Temperature in retort 2 is therefore controlled by the operation of flow controller 46 upon flow control valve 48, which adjusts the flow of hot gases to the retort. The second portion of the recycle gas stream enters vessel 6 via conduit 10 as the fluidizing gas stream at a rate under the control of flow controller 28 and flow control valve 26 as is described in greater detail hereinafter.

Educed shale oil vapors (including those recovered via conduit 56 from fluidized retorting of fines and crushed retorted particles in vessel 6) pass downwardly with the recycle gas into the lower regions of retort 2 wherein the cool oil shale condenses shale oil vapors, so that liquid shale oil is withdrawn via conduct 7, while uncondensed vapors are sent to a recovery facility (not shown) via conduit 9. Thus, product obtained from retorting fines in surge vessel 6 is treated together with product obtained from the primary shale retort 2 in a single treating facility.

Retorted particles are removed from retort 2 via chute 12 at an elevated temperature, typically between about 900° and about 1000° F. and preferably between about 900° and about 950° F., and passed in series and in vertical alignment through (1) a recovery means suitable for installation above ground for removing shale particles from the retort without substantial loss of pressure and without substantial loss of retort gases, (2) a crusher to reduce the retorted shale particles to a size suitable for fluidization under substantially retorting pressure, and (3) a fluidized fines eduction and transfer system for obtaining product hydrocarbon vapors from raw shale fines and subsequently delivering the crushed particles to a fluidized cooler (not shown) for cooling before disposal or, alternatively, to a fluidized bed combustor (not shown) for recovery of heat energy from the retorted particles.

The drawing sets forth one combination of apparatus integral with retort 2 to achieve the foregoing objectives, said apparatus being comprised generally of chute 12, transfer means housed within conduit 14, crusher 4, surge vessel 6, solids flow control valve 16, and gas lift 32, along with the conduits leading therebetween. In the actual practice of this invention, however, several such combinations may operate in parallel, for example, between two and ten such combinations. In the preferred embodiment, four combinations of apparatus, each one operating with the shale flow rates hereinafter specified, transfer shale removed from retort 2 to gas lift 32 while heat available from the crushed shale particles is used to raise raw shale fines in surge vessel 6 to retorting temperatures, causing the kerogen in the fines to decompose and release hydrocarbonaceous vapors. Vapors educed from the fines in each combination of apparatus are returned to retort 2 and subsequently condensed and separated as hereinbefore described.

The shale particles gravitate from retort 2 through chute 12 into a means for transporting solids such as a vibrating feeder, or, preferably, a screw conveyor or star feeder housed within conduit 14, at a rate typically between about 50 and about 250 tons per hour, preferably between about 100 and about 115 tons per hour, so that each combination of apparatus in the preferred embodiment receives about one fourth of the retorted shale flowing from retort 2. The shale particles are fed into crusher 4 through standpipe 18 at a rate controlled by response of the drive mechanism on the feeder within conduit 14 to level controller 22, which is adapted to ensure that a continuous column of shale moves through chute 12 and conduit 14.

Retorted shale particles are crushed to a size suitable for fluidization to facilitate their ultimate depressurization through gas solids flow control valve 16, which reduces pressure on the particles from retorting pressure to a pressure suitable for cooling particles before disposal or for combustion, for example about 12 p.s.i.g. Crushing the shale particles also promotes further eduction of hydrocarbon vapors from the retorted particles as well as retorting of fines in surge vessel 6 by providing for maximum heat transfer between the crushed, heated particles and raw fines under fluidized conditions. In alternative embodiments of this invention, heat is recovered from retorted shale by burning the coke contained therein in a fluidized bed combustor after recovery via gas lift 32, which embodiment also requires that the retorted shale be in a crushed form. In crusher 4, therefore, the shale particles are reduced to a size usually no greater than ½ inch, and preferably to less than ⅜ inch, and usually no more than ¼ inch in mean diameter. The crusher itself may be any suitable device for reducing the size of particulate solids, preferably with a minimum of fines production, and even more preferably in a fluid-tight manner when operated at the desired pressure for crushing. Typical crushers suitable for use herein include toothed roll crushers, jaw crushers, cone crushers, and hammer or impact crushers, with the hammer crusher being preferred for its usefulness in minimizing fines production, efficiency under pressurized conditions, and high capacities relative to the size of the machines.

The crusher may operate at any desired pressure compatible with the retort pressure, but, preferably, the pressure in the crusher is substantially that of the retort. Since the preferred retorting pressure is superatmospheric, pressure in the crusher is therefore preferably also superatmospheric, usually between about 5 and 30 p.s.i.g., and preferably about 15 p.s.i.g.

Crushed shale particles are passed from crusher 4 through standpipe 20 into surge vessel 6 where the solids are maintained in a fluidized state by a fluidizing gas stream comprised of recycled product gases educed from raw shale particles in retort 2 and from the raw shale fines and retorted particles in surge vessel 6. The fluidizing gas stream is augmented in vessel 6 by a major portion of a small stripping stream comprising steam which enters vessel 6 through conduit 44 and standpipe 36 with sufficient volume to prevent leakage of educed gases from vessel 6 through standpipe 36 and valve 16. The fluidizing gas is introduced via conduit 10 into the lower region of surge vessel 6 at a rate sufficient to maintain the retorted shale particles as a fluidized bed, while the pressure in the upper region of vessel 6 is preferably balanced as hereinafter described so that, at most, only a trace of gas flows through standpipe 20 and crusher 4 either to or from retort 2. The balance of pressures in vessel 6, therefore, seals the retort and forestalls escape of retort gases. In the preferred embodiment, the flow of the fluidizing gas stream, as determined by response of flow control valve 26 to flow controller 28, is usually between 4,000 and 8,000, and preferably about 5,000 standard cubic feet per minute per 111.5 tons of retorted shale fed through chute 12 per hour. In surge vessel 6 the hot fluidizing gas stream and hot, crushed particles impart sufficient heat to the raw fines during contact in the fluidized bed to educe hydrocarbonaceous vapors from the fines while the crushed particles undergo further retorting of residual hydrocarbonaceous materials made more accessible by the crushing.

Meanwhile, raw shale fines, which typically range in size from zero (as a fine dust) to ⅜ inch, and preferably from zero to ⅛ inch mean diameter, are introduced into surge vessel 6 via conduit 34 using any convenient means of transporting fine particulates to a system being maintained at superatmospheric pressure, such as lock hoppers, screw conveyors, or dilute-phase lift systems. Once introduced into vessel 6, the raw fines are caught up in the turbulent motion of the fluidized bed of crushed particles, increasing to the temperature of pyrolysis by contact with the heated fluidizing gases and particulate heat source. Agglomeration of the fines during pyrolysis is avoided due to the turbulent motion of the fines and particles in the fluidized bed.

In a proportion ranging from about 1 to about 45 percent by weight of the total retorted shale particles from chute 12, preferably between about 5 and about 10 tons per hour, typically up to about 12.5 tons per hour, and most preferably between about 6 and about 8 tons per hour, fines are introduced into vessel 6 and retorted at essentially the pressure prevailing in the retort, usually between about 5 and about 30 p.s.i.g., and preferably about 15 p.s.i.g., and a temperature typically between about 800° and about 1000° F., and preferably between about 825° and about 900° F. To assure the optimum yield of hydrocarbonaceous vapors, the raw fines are maintained in vessel 6 at the above temperature and pressure for a period of time sufficient to educe said hydrocarbonaceous vapors, typically between about 1.0 and about 5.0 minutes, and preferably between about 1.5 and about 2.5 minutes. Retorting the fines under these conditions typically yields hydrocarbonaceous vapors containing between 80 and 100 percent of the Fischer assay of the raw fines, and, in the preferred embodiment, the yield is at least 90 percent of Fischer assay.

After being retorted, a substantial proportion of the fines gravitates from vessel 6 via standpipe 36 with the retorted shale particles while a minor portion of the fines, usually between 10 and 40, and preferably between 15 and 25 tons per hour, is removed as entrained particulates via conduit 24 in the educed gas stream. The entrained particles are removed from the gases in conduit 24 by any suitable means for separating gases from particulate solids, such as cyclone separator 58.

To forestall loss of vapors educed from the fines in vessel 6 during removal of the fines and retorted shale particles from vessel 6 through standpipe 36 and to strip hydrocarbonaceous vapors from the retorted shale, a countercurrently flowing stripping stream of inert gas, preferably steam, is directed into standpipe 36 via conduit 44 at a flow rate of between about 10 and 50, preferably 30 cubic feet per ton of retorted shale passing through standpipe 36. The volume of the stripping steam is sufficient so that a substantial proportion of the stripping steam passes upward through the interstices in the gravitating column of particles and fines in standpipe 36 and into vessel 6. Consequently, escape is prevented of educed product vapors in the void spaces of the column of particles and fines gravitating from vessel 6 through standpipe 36.

Substantially all of the educed vapors flow from vessel 6 via conduit 24 and from there into retort 2 via separator 58 and conduit 56 along with the major portion of the stripping steam. A minor portion of the stripping steam, caught in the void spaces in the column of particles and fines, passes out of standpipe 36 through solids flow control valve 16 and standpipe 38 into gas lift 32.

One of the functions of the combination of apparatus between retort 2 and gas lift 32 is to prevent escape of retort gases while retorted shale is removed and depressurized. The retort may operate at any pressure, but preferably the pressure of the retort is different from that of the cooler or fluidized bed combustor, and more preferably higher than that of the cooler, and most preferably the retort is at a greater superatmospheric pressure than the superatmospheric pressure of the cooler or fluidized bed combustor. Pressures in the combination of apparatus between retort 2 and gas lift 32 are preferably balanced to prevent any significant flow of gases either to or from retort 2 through conduit 12. Flow controller 28, operating upon flow control valve 26, supplies sufficient gas to fluidize the particles in surge vessel 6. The typical rate of flow of the educed gas stream in conduit 24 will be maintained substantially equal to the flow of the fluidizing gas stream through conduit 10 plus the vapors educed in vessel 6 from the raw shale fines. Flow of vapors through conduit 12 into retort 2 is minimal being restricted by the solids in conduit 12.

The crushed shale particles and a substantial portion of the retorted fines, accompanied by a small portion of the stripping stream, are substantially reduced in pressure while being passed from vessel 6 via standpipe 36, pressure-reducing solids flow control valve 16, and standpipe 38 into gas lift 32, typically to a pressure between about 2 and about 15 p.s.i.g., and preferably to about 10 p.s.i.g. In the preferred embodiment, solids flow control valve 16 is a slide valve for operation with fluidized solids actuated by level controller 40. The rate of flow of the portion of the fluidizing gas stream which passes from vessel 6 into conduit 32 is preferably substantially equal to the void space in the gravitating shale bed passing through control valve 16 and ranges between about 100 and about 200 standard cubic feed per minute.

In the preferred embodiment, conduit 32 is a dilute phase gas lift through which the crushed shale particles from standpipe 38 are transported by the entraining action of a carrier gas stream directed therein via conduit 42 at a velocity and pressure sufficient to elevate the particles to the entrance of a fluidized cooler or fluidized combustor. The carrier gas stream typically comprises any inert gas or air but is preferably air fed into conduit 32 through conduit 42 at a rate controlled by the operation of flow controller 54 upon flow control valve 52, typically between about 8,000 and about 12,000, and preferably between about 9,000 and about 10,000 standard cubic feet per minute.

In a first alternative embodiment of the invention, the crushed retorted particles removed from surge vessel 6 via standpipe 36, solids flow control valve 16, standpipe 38 and conduit 32 are transported to a heat exchange vessel (not shown) in which heat is recovered from the hot particles by conventional methods of indirect heat exchange with a stream of water or other process fluids, which exits from the heat exchange vessel at a temperature substantially higher than that at which it enters. To promote indirect heat exchange with the fluid stream, the crushed particles are typically maintained as a fluidized bed within the heat exchange vessel. After heat exchange, the crushed retorted particles are removed from the heat exchange vessel at a substantially reduced temperature and subsequently passed to a cooler for additional cooling. A fluidized cooler suitable for use in this invention is disclosed more fully in U.S. patent application, Ser. No. 451,602, filed Dec. 20, 1982, which is hereby incorporated by reference.

In a second alternative embodiment, retorted shale particles are not sent to a cooler for cooling, but once used to provide heat for retorting raw shale fines, are recovered via standpipe 36, solids flow control valve 16, and standpipe 38, and sent entrained in a carrier gas stream via gas lift 32 to a conventional fluidized bed combustor wherein residual carbonaceous and/or hydrocarbonaceous materials on the fines and particulates are burned for secondary energy recovery from hot combustion fine gases.

A single-stage fluidized combustor, such as that disclosed in a U.S. Pat. No. 4,435,271 issued Mar. 6, 1984, which is hereby incorporated by reference, or staged-bed fluidized combustor, such as that disclosed in U.S. patent application Ser. No. 495,505 filed May 17, 1983, which is hereby incorporated by reference, may be used to recover residual energy from retorted shale by burning coke contained in the crushed particles. Combustion of retorted shale particles with subsequent heat recovery from combustion flue gases substantially increases the total energy recovered from the raw shale.

The process for retorting raw hydrocarbon-containing fines as above described provides significant advantages. When used in a process utilizing a conventional upflow oil shale retort, an increase is achieved of as much as 6 percent in net product yielded from the shale after the energy requirements for retorting and recovering product as herein described have been met, a figure which represents a considerable increase in energy recovery from the retorting process. An additional benefit of retorting raw fines using the process of this invention is that agglomeration of the fines during retorting is substantially reduced by the turbulent motion of the fines and particles in the fluidized bed. Yet another advantage of the process of this invention is that the fluidized zone in which the fines are retorted serves the additional function of providing a seal to the retort, which prevents escape of product gases from the retort while crushed, retorted particles are depressurized and removed from the retorting system without plugging.

Perhaps the greatest advantage of this invention is that a single retorting gas is employed in both retorting zones with common treatment downstream of conduit 9 for recovery of product, thus obviating separate facilities for treating gases in conduit 9 and conduit 56. Delicately balanced pressure in vessel 6 is also not required because the single treatment facility makes possible flow of gases from the retort to the fluidization zone or vice versa.

Although the invention has been described in conjunction with a preferred embodiment thereof, it is evident that many alternatives, modifications, and variations will be apparent to those skilled in the art in light of the foregoing description. For example, a variety of hydrocarbon-containing particulates may be used in the process of the invention, including coal and lignite. Accordingly, it is intended to embrace this and all such alternatives, modifications, and variations that fall within the spirit and scope of the appended claims.

I claim:

1. A process for retorting raw hydrocarbon-containing fines, which process comprises:

(1) retorting hydrocarbon-containing particles of a size not readily fluidizable in a retorting zone by contacting said particles at an elevated temperature with a first recycled portion of an eduction gas comprising (a) recycled hydrocarbon vapors educed from said particles in said retorting zone and (b) hydrocarbon vapors educed in step (4) and recovered in step (5) hereinafter;

(2) crushing hot, uncombusted particles removed from said retorting zone in a crushing zone to a size more readily fluidizable;

(3) maintaining hot, crushed, uncombusted particles removed from said crushing zone in a fluidization zone as a fluidized bed under substantially non-combustive conditions and fluidized with a gas comprising a second recycled portion of the eduction gas;

(4) introducing raw hydrocarbon-containing fines into said fluidization zone so as to educe hydrocarbon vapors from said fines;

(5) recovering the educed hydrocarbons vapors from said fluidization zone; and (6) recovering retorted particulates from said fluidization zone.

2. The process defined in claim 1 wherein said crushed umcombusted particles are retorted in said fluidization zone so as to educe additional hydrocarbon vapors from said particles, said additional vapors being recovered in step (5).

3. A process for retorting raw oil shale fines, which process comprises:

(1) retorting raw shale particles of a size not readily fluidizable in an upflow shale retorting zone by contacting said particles with a heated mixture of a first portion of recycled eduction vapors comprising (a) hydrocarbon vapors educed from said particles in said retorting zone and (b) hydrocarbon vapors educed in step (3) and recovered in step (4) hereinafter;

(2) crushing heated, coke-containing shale particles removed from said retorting zone in a crushing zone to a size more readily fluidizable;

(3) maintaining hot, crushed, coke-containing shale particles removed from said crushing zone in a fluidization zone as a fluidized bed under substantially non-combustive conditions in which fluidization zone raw hydrocabon-containing shale fines are introduced and retorted so as to educe hydrocarbon vapors from said fines, the retorting in said fluidization zone being accomplished with a second recycled portion of the eduction vapors in step (1);

(4) recovering the educed hydrocarbon vapors;

(5) recycling said educed hydrocarbon vapors to said retorting zone; and (6) recovering retorted particulates from said fluidization zone.

4. The process defined in claim 3 wherein the crushed, coke-containing shale particles are retorted in said fluidization zone so as to educe additional hydrocarbon vapors from said particles, said additional vapors being recovered in step (4).

5. A process for retorting raw hydrocarbon-containing fines using heat from retorted particles, which process comprises:

(1) retorting raw shale particles of a size not readily fluidizable in an upflow retorting zone by contacting said particles at an elevated temperature with a first recycled portion of eduction vapors comprising (a) hydrocarbon vapors educed from said particles in said retorting zone and (b) hydrocarbon vapors educed in step (4) and recovered in step (5) hereinafter;

(2) removing hot, retorted coke-containing particles from the retorting zone without substantial loss of heat or substantial loss of retort vapors and passing said particles into a crushing zone;

(3) crushing said hot particles removed from said retorting zone in a crushing zone to a size more readily fluidizable;

(4) maintaining crushed, coke-containing particles removed from said crushing zone in a heated condition, as a fluidized bed fluidized with a gas comprising a second recycled portion of the eduction vapors in a fluidization zone under substantially non-combustive conditions at a temperature sufficient to educe hydrocarbon vapors from raw, unretorted hydrocarbon-containing fines, into which fluidization zone (a) raw hydrocarbon-containing fines are introduced and retorted so as to educe hydrocarbon vapors from said fines; and (b) the crushed, coke-containing particles are retorted so as to educe additional hydrocarbon vapors from said particles;

(5) recovering the educed hydrocarbon vapors from the fluidization zone;

(6) recycling said educed hydrocarbon vapors to said retorting zone; and (7) recovering said crushed particles and a substantial portion of said fines from said fluidization zone.

6. A process as defined in claim 5 further comprising:

(8) transporting said crushed particles and fines recovered from said fluidization zone to a cooling zone; and (9) cooling said crushed particles and fines in a cooling zone.

7. A process as defined in claim 5 wherein fines are removed from said educed hydrocarbon vapors recovered from the fluidization zone in a separation zone before the vapors are recycled to the rotating zone, the separated fines being returned to the fluidization zone.

8. A process as defined in claim 5, which process further comprises:

(8) recovering product hydrocarbon liquids and vapors from said retorting zone;

(9) transporting crushed particles and fines from said fluidization zone to a cooling zone using a carrier gas stream; and

(10) cooling said crushed particles and fines in the cooling zone.

9. A process as defined in claim 8 wherein said transporting is carried out by means of entrainment of the crushed particles and fines in a flowing carrier gas stream.

10. A process as defined in claim 8 wherein said crushing zone is maintained at substantially retorting pressure and said fluidization zone is maintained at substantially retorting pressure.

11. A process as defined in claim 8 wherein fines are removed from said educed hydrocarbons vapors recovered from the fluidization zone in a separation zone before the vapors are recycled to the retorting zone, the separated fines being returned to the fluidization zone.

12. A process for retorting raw shale fines using heat from retorted shale particles, which process comprises:

(1) retorting raw shale particles of a size not readily fluidizable at elevated temperature in an upflow retorting zone by contacting said particles with a first recycled portion of eduction vapors comprising (a) product vapors educed from said particles in said retorting zone and (b) hydrocarbon vapors educed in step (4) and recovered in step (5) hereinafter;

(2) removing hot, coke-containing retorted shale particles from the retorting zone without substantial loss of heat or substantial loss of retort vapors and passing said particles into a crushing zone;

(3) crushing said hot, coke-containing shale particles recovered from said retorting zone in a crushing zone to a size more readily fluidizable;

(4) maintaining hot, crushed, coke-containing shale particles from said crushing zone as a fluidized bed fluidized with a gas comprising a second recycled portion of the eduction vapors in a fluidization zone under substantially non-combustive conditions at a temperature sufficient to educe hydrocarbon vapors from raw unretorted shale fines into which fluidization zone (a) raw shale fines are introduced and retorted so as to educe hydrocarbon vapors from said fines; and (b) the crushed, coke-containing particles are retorted so as to educe additional hydrocarbon vapors from said particles;

(5) recovering the educed hydrocarbon vapors from said fluidization zone;

(6) passing the recovered hydrocarbon vapors to said retorting zone;

(7) recovering product hydrocarbon liquids and vapors from educed hydrocarbon vapors in said retorting zone;

(8) recovering the crushed shale particles and a substantial portion of said fines from said fluidization zone; and (9) recycling a first portion of the product vapors to said retorting zone and a second portion of the product hydrocarbon vapors to said fluidization zone.

13. A process as defined in claim 12 further comprising:

(10) transporting crushed particles and retorted fines from said fluidization zone to a cooling zone;

(11) cooling said crushed shale particles and retorted fines in said cooling zone.

14. A process as defined in claim 13 wherein said transporting is carried out by means of entrainment of the crushed particles and fines in a flowing carrier gas stream.

15. A process as defined in claim 12 further comprising:

(10) transporting crushed particles and retorted fines from said fluidization zone to a fluidized bed combustion zone;

(11) combusting said crushed particles and retorted fines in said fluidized bed combustion zone to produce hot flue vapors; and

(12) recovering heat energy from said hot flue vapors.

16. A process as defined in claim 15 wherein said transporting is carried out by means of entrainment of the crushed particles and fines in a flowing carrier gas stream.

17. A process for retorting raw shale fines using heat from retorted shale particles, which process comprises:

(1) retorting raw shale particles of a size not readily fluidizable in an upflow retorting zone by contacting said particles at an elevated temperature with vapors comprising a first portion of heated recycle product vapors recovered from said retorting zone in step (9) hereinafter;

(2) removing hot, coke-containing retorted shale particles from the retorting zone without substantial loss of heat or substantial loss of retort vapors and passing said particles into a crushing zone;

(3) crushing said hot, coke-containing shale particles recovered from said retorting zone in a crushing zone to a size more readily fluidizable;

(4) maintaining hot, crushed, coke-containing shale particles recovered from said crushing zone as a fluidized bed by injecting a non-oxidizing fluidizing gas into said fluidization zone comprising a second portion of said recycle product vapors recovered from said retorting zone, the heat in said fluidizing gas being sufficient to maintain said fluidization zone at a temperature sufficient to educe hydrocarbon vapors from said fines, into which fluidization zone (a) raw shale fines are introduced and retorted so as to educe hydrocarbon vapors from said fines; and (b) the crushed particles are retorted so as to educe additional hydrocarbon vapors from said particles;

(5) recovering the educed hydrocarbon vapors from said fluidization zone;

(6) removing fines from said educed vapors in a zone of separation;

(7) recycling fines-free educed vapors to said retorting zone;

(8) recycling recovered fines to said fluidization zone;

(9) recovering product hydrocarbon liquids and vapors from said retorting zone; and

(10) recovering said crushed shale particles and a substantial portion of said fines from said fluidization zone.

18. A process as defined in claim 17 wherein pressure in the upper region of said fluidization zone is maintained substantially equal to the pressure in the crushing zone, the pressure in the crushing zone is maintained substantially equal to the pressure in the retorting zone, and the gas pressure on the particles and fines recovered from said fluidization zone is reduced to about atmospheric while being recovered from said fluidization zone through said solids flow control valve.

19. A process as defined in claim 17 wherein said retorting zone is operated at a pressure of about 20 p.s.i.g. or more and at a temperature in excess of about 900° F.

20. A process as defined in claim 17 wherein said crushed retorted particles are less than ½ inch in mean diameter, said raw fines range in size from a fine dust to ⅜-inch mean diameter, the amount of fines added to said fluidization zone is from about 1 to about 45 weight percent of the crushed particles held therein as a fluidized bed, and the energy recovered from the retorting process is increased by the additional product yielded by retorting said fines.

21. A process as defined in claim 20 wherein hydrocarbon vapors recovered from said fluidization zone comprise at least about 90 percent of the Fischer assay of the raw fines.

22. A process as defined in claim 20 wherein said transporting is carried out by entrainment in a flowing carrier gas stream.

23. A process as defined in claim 17 wherein the hydrocarbon vapors recovered from said fluidization zone comprise at least about 80 percent of the Fischer assay of the raw fines.

24. A process as defined in claim 17 further comprising:

(14) transporting said crushed shale particles and fines recovered from said fluidization zone to a cooling zone; and

(15) cooling said particles and fines in said cooling zone.

25. A process for retorting raw shale fines using heat from retorted shale particles, which process comprises:

(1) retorting raw shale particles of a size not readily fluidizable in an upflow retorting zone operating at a temperature in excess of 900° F. and at a superatmospheric pressure by contacting said particles with a first portion of recycled eduction vapors comprising (a) hydrocarbon vapors educed from said particles in said retorting zone and (b) hydrocarbon vapors educed in step (4) and recovered in step (6) hereafter;

(2) removing hot, coke-containing retorted shale particles from the retorting zone without substantial loss of heat or substantial loss of retort vapors and passing said particles into a crushing zone;

(3) crushing said hot, coke-containing shale particles recovered from said retorting zone in a crushing zone maintained at substantially retorting pressure to a size more readily fluidizable;

(4) holding hot, crushed, coke-containing shale particles from said crushing zone in a fluidization zone maintained as a fluidized bed by the action of a fluidizing gas stream comprising a second portion of said eduction vapors directed therein at a rate sufficient to maintain said particles as a fluidized bed, into which fluidization zone (a) raw shale fines are introduced and retorted to educe hydrocarbon vapors, which hydrocarbon vapors comprise about 90 percent of the Fischer assay of the carbon compounds contained in said fines; and (b) the crushed, hot, coke-containing particles are retorted to educe additional hydrocarbon vapors;

(5) discharging the crushed particles and a substantial proportion of said fines from said fluidization zone while restricting the rate at which vapors are removed therefrom together with said particles;

(6) recovering the educed hydrocarbon vapors from said fluidization zone;

(7) separating entrained fines from said hydrocarbon vapors recovered from said fluidization zone in a separation zone, which fines are returned to said fluidization zone;

(8) passing substantially fines-free educed vapors to said retorting zone;

(9) recovering product hydrocarbon liquids and vapors from said retorting zone;

(10) recycling a first portion of said recovered hydrocarbon vapors to said retorting zone to comprise the eduction vapors and a second portion to said fluidization zone to comprise the fluidizing gas stream;

(11) transporting particles and fines discharged from said fluidization zone to a cooling zone by entraining said particles and fines in a carrier gas stream comprising inert gas; and

(12) cooling said particles and fines in said cooling zone.

26. A process as defined in claim 25 wherein said crushed retorted shale particles are less than ½ inch in mean diameter, said raw shale fines range in size from a fine dust to ⅜ inch mean diameter, the temperature of said fluidization zone is from about 800° F. to about 900° F., the amount of fines added to said fluidization zone is from about 1 to about 45 weight percent of the crushed particles held therein as a fluidized bed, and the energy recovered from the retorting process is increased by the additional product yielded by retorting said raw shale fines.

27. A process as defined in claim 25 wherein said fines are retorted in said fluidization zone at a temperature of about 850° F. for a residence time of about 2 minutes and the educed hydrocarbon vapors recovered from said fluidization zone comprise at least about 80 percent of the Fischer assay of the raw shale fines.

28. A process as defined in claim 27 wherein the educed hydrocarbon vapors recovered from said fluidization zone comprise at least about 90 percent of the Fischer assay of the raw shale fines.

29. A process as defined in claim 25 wherein pressure in the upper region of said fluidization zone is maintained at substantially retorting pressure, the gas pressure on said crushed particles and fines being reduced to about 12 p.s.i.g. or less during recovery from said fluidization zone through a pressure-reducing means.

30. A retorting process comprising:

(1) retorting hydrocarbon-containing particles of a size greater than ½ inch mean diameter in a retorting zone by contact with a first recycled portion of heated eduction gases comprising (a) hydrocarbon vapors educed from said particles in said retorting zone and (b) hydrocarbon vapors educed in step (4) and recovered in step (5) hereinafter;

(2) crushing hot, uncombusted particles removed from said retorting zone in a crushing zone to a size less than ½ inch mean diameter;

(3) maintaining hot, crushed, uncombusted particles removed from said crushing zone in a fluidization zone as a fluidized bed under substantially non-combustive conditions fluidized with a gas comprising a second recycled portion of the eduction gases;

(4) introducing raw hydrocarbon-containing fines into said fluidization zone so as to educe hydrocarbon vapors from said fines;

(5) recovering the educed hydrocarbon vapors from said fluidization zone; and (6) recovering retorted particulates from said fluidization zone.

31. A process for retorting oil shale, which process comprises:

(1) retorting raw shale particles of a size greater than ½ inch mean diameter in an upflow retorting zone by contact with a heated mixture of a first recycled portion of eduction vapors comprising (a) hydrocarbon vapors educed from said particles in a retorting zone and (b) hydrocarbon vapors educed in step (4) and recovered in step (5) hereinafter;

(2) crushing heated, coke-containing shale particles removed from said retorting zone in a crushing zone to a size less than ½ inch mean diameter;

(3) maintaining hot, crushed, coke-containing shale particles removed from said crushing zone in a fluidization zone as a fluidized bed under substantially non-combustive conditions fluidized with a gas comprising a second recycled portion of the eduction vapors;

(4) introducing raw hydrocarbon-containing shale fines into said fluidization zone so as to educe hydrocarbon vapors from said fines;

(5) recovering the educed hydrocarbon vapors from said fluidization zone; and (6) recovering retorted particulates from said fluidization zone.

32. A process for retorting raw hydrocarbon-containing fines using heat from retorted particles, which process comprises:

(1) retorting raw shale particles of a size greater than ½ inch mean diameter in an upflow retorting zone by contact with a heated mixture of a first recycled portion of eduction vapors comprising (a) hydrocarbon vapors educed from said particles in a retorting zone and (b) hydrocarbon vapors educed in step (4) and recovered in step (5) hereinafter;

(2) crushing hot particles removed from said retorting zone in a crushing zone to a size less than ½ inch mean diameter;

(3) maintaining crushed, coke-containing particles removed from said crushing zone in a heated condition as a fluidized bed in a fluidization zone fluidized with a gas comprising a second recycled portion of the eduction vapors under substantially non-combustive conditions at a temperature sufficient to educe hydrocarbon vapors from unretorted hydrocarbon-containing fines;

(4) introducing raw hydrocarbon-containing fines into said fluidization zone so as to educe hydrocarbon vapors from said fines;

(5) recovering the educed hydrocarbon vapors from said fluidization zone; and (6) recovering said crushed particles and a substantial portion of said fines from said fluidization zone.

33. A process for retorting raw shale fines using heat from retorted shale particles, which process comprises:

(1) retorting raw shale particles of a size greater than ½ inch mean diameter in an upflow retorting zone by contact with a heated mixture of a first recycled portion of an eduction gas comprising (a) hydrocarbon vapors educed from said particles in a retorting zone and (b) hydrocarbon vapors educed in step (4) and recovered in step (5) hereinafter;

(2) removing hot, coke-containing, retorted shale particles from the retorting zone without substantial loss of heat or substantial loss of retort gases and passing said particles into a crushing zone;

(3) crushing said hot, coke-containing retorted shale particles recovered from said retorting zone in the crushing zone to a size less than ½ inch mean diameter;

(4) maintaining hot, crushed, retorted coke-containing, shale particles from said crushing zone as a fluidized bed in a fluidization zone fluidized with a gas comprising a second recycled portion of the eduction gas under substantially non-combustive conditions at a temperature sufficient to educe hydrocarbon vapors from unretorted shale fines;

(5) introducing raw shale fines into said fluidization zone so as to educe hydrocarbon vapors from said fines;

(6) recovering the educed hydrocarbon vapors from said fluidization zone; and (7) recovering the crushed shale particles and a substantial portion of said fines from said fluidization zone.

34. A process as defined in claim 33 wherein hydrocarbon products recovered from said educed hydrocarbon vapors are at least about 90 percent of the Fischer assay of the raw fines.

35. A process as defined in claim 33 wherein said retorting zone is operated at a pressure of about 20 p.s.i.g. or more and at a temperature in excess of about 900° F.

36. A process as defined in claim 33 wherein said raw fines range in size from a fine dust to ⅜ inch mean diameter, the temperature of said hydrocarbon vapors recovered from step (4) is from about 800° F. to about 900° F., said fluidization zone is maintained at a temperature between about 850° F. and about 950° F., the amount of fines added to said fluidization zone is from about 1 to about 45 weight percent of the crushed particles held therein as a fluidized bed, and the energy recovered from the retorting process is increased by the additional product yielded by retorting said fines.

37. A process as defined in claim 33 wherein the hydrocarbon products recovered from said educed hydrocarbon vapors are at least about 80 percent of the Fischer assay of the raw fines.

38. The process defined in claims 30, 31, 32, or 33 wherein the retorting zone, the crushing zone and the fluidization zone are in fluid communication and the retorting zone is maintained at superatmospheric pressure while gas pressure in said crushing zone is essentially equal thereto so that essentially no gases flow from said retorting zone into said crushing zone or into said retorting zone from said crushing zone.

39. The process defined in claim 30, 31, 32 or 33 wherein the particles are crushed in said crushing zone to a size less than ¼ inch mean diameter.

40. The process defined in claims 30, 31, 32 or 33 wherein the particles are crushed in said crushing zone to a size less than ⅜ inch mean diameter.

41. A process as defined in claim 30, 31, 32 or 33 wherein said retorting zone is operated at a pressure of about 20 p.s.i.g. or more and at a temperature in excess of 900° F.

42. A process as defined in claim 30, 31, 32, or 33 wherein said raw fines range in size from a fine dust to ⅜ inch mean diameter, the temperature of said educed hydrocarbon vapors recovered from said fluidization zone is from about 800° F. to about 900° F., said zone of fluidization is maintained at a temperature between about 850° and about 950° F., the amount of fines added to said fluidization zone is from about 1 to about 45 weight percent of the crushed particles held therein as a fluidized bed, and the energy recovered from the retorting process is increased by the additional product yielded by retorting said fines.

43. A process as defined in claim 30, 31, 32 or 33 wherein the hydrocarbon products recovered from said educed hydrocarbon vapors are at least about 80 percent of the Fischer assay of the raw fines.

* * * * *